US008291732B2

(12) United States Patent
Ramsauer et al.

(10) Patent No.: US 8,291,732 B2
(45) Date of Patent: Oct. 23, 2012

(54) RETRACTABLE HAND LEVER ACTUATOR WHICH MAY BE LOCKED IN A RECESS

(75) Inventors: Dieter Ramsauer, Schwelm (DE); Klaus Bergmann, Essen (DE); Reinhard Gottschling, Essen (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 366 days.

(21) Appl. No.: 12/593,040

(22) PCT Filed: Feb. 15, 2008

(86) PCT No.: PCT/EP2008/001162

§ 371 (c)(1),
(2), (4) Date: Oct. 15, 2009

(87) PCT Pub. No.: WO2008/116533

PCT Pub. Date: Oct. 2, 2008

(65) Prior Publication Data

US 2010/0107803 A1 May 6, 2010

(30) Foreign Application Priority Data

Mar. 27, 2007 (DE) ..... 20 2007 004 435 U

(51) Int. Cl.
*G05G 1/10* (2006.01)

(52) U.S. Cl. ..... 70/208; 70/207; 70/209; 70/423; 70/424; 70/455; 292/32; 292/33; 292/37; 292/38; 292/40; 292/42; 292/336.3; 292/DIG. 31

(58) Field of Classification Search ..... 70/207, 70/208, 209, 416, 423, 424, 427, 428, 455; 292/32, 33, 37, 38, 40, 42, 336.3, DIG. 31
See application file for complete search history.

(56) References Cited

U.S. PATENT DOCUMENTS

| | | | | | |
|---|---|---|---|---|---|
| 4,167,104 | A | * | 9/1979 | Bond | 70/208 |
| 4,631,937 | A | * | 12/1986 | Debus et al. | 70/207 |
| 4,898,408 | A | * | 2/1990 | Hauber | 292/7 |
| 4,993,247 | A | * | 2/1991 | Minemura | 70/208 |
| 5,272,894 | A | * | 12/1993 | Stillwagon et al. | 70/208 |
| 5,921,119 | A | * | 7/1999 | Myers et al. | 70/208 |

(Continued)

FOREIGN PATENT DOCUMENTS

DE 3243029 5/1984

(Continued)

*Primary Examiner* — Lloyd Gall
*Assistant Examiner* — Ifeolu Adeboyejo
(74) *Attorney, Agent, or Firm* — Frommer Lawrence & Haug LLP

(57) ABSTRACT

A retractable hand lever actuator which can be locked in a trough for driving a latch for a switch cabinet or the like is described. The hand lever is articulated at a drive shaft supported in the trough. According to the invention, the hand lever actuator comprises a handle such as a T-handle or L-handle having two connection levers which are arranged relative to one another in a parallelogram configuration and which are articulated by one end at the drive shaft and by the other end in a similar manner at the handle in such a way that, on the one hand, they hold the handle in its direction parallel to the extension of the trough when the handle is folded out of the trough and, on the other hand, are able to transmit a rotational movement of the handle to the drive shaft in the folded out position.

20 Claims, 7 Drawing Sheets

U.S. PATENT DOCUMENTS

| | | | | |
|---|---|---|---|---|
| 6,263,712 | B1 | 7/2001 | Ramsauer | |
| 6,474,119 | B1 * | 11/2002 | Halvorson et al. | 70/208 |
| 6,497,437 | B1 * | 12/2002 | Munch et al. | 292/336.3 |
| 6,564,597 | B1 * | 5/2003 | Stillwagon | 70/208 |
| 6,867,685 | B1 * | 3/2005 | Stillwagon | 340/5.64 |
| 2010/0171326 | A1 * | 7/2010 | Bacon | 292/336.3 |
| 2011/0156411 | A1 * | 6/2011 | Commons et al. | 292/336.3 |
| 2011/0176320 | A1 * | 7/2011 | Liu | 362/427 |

FOREIGN PATENT DOCUMENTS

| | | |
|---|---|---|
| EP | 0206887 | 12/1986 |
| WO | WO 9901632 | 1/1999 |

* cited by examiner

RETRACTABLE HAND LEVER ACTUATOR WHICH MAY BE LOCKED IN A RECESS

The present application claims priority from PCT Patent Application No. PCT/EP2008/001162 filed on Feb. 15, 2008, which claims priority from German Patent Application No. 20 2007 004 435.6 filed on Mar. 27, 2007, the disclosure of which is incorporated herein by reference in its entirety.

BACKGROUND OF THE INVENTION

1. Field of the Invention

The invention is directed to a retractable hand lever actuator which can be locked in a trough for driving a latch for a switch cabinet or the like, wherein the hand lever is articulated at a drive shaft which is supported in the trough.

2. Description of Related Art

A hand lever actuator of the type mentioned above is already known from DE 32 43 029 C3 and also from WO 99/01632.

In both cases, the hand lever actuator comprises a folding handle which can be grasped by hand and which extends diagonally when folded out so that it is sometimes more difficult to operate than when the part of the lever that can be grasped remains parallel to the door leaf. Further, the space between the handle and the trough is relatively small, which further impedes operation.

SUMMARY OF THE INVENTION

It is the object of the invention to provide a hand lever actuator of the type mentioned above in which the part of the handle that can be grasped remains parallel to the door leaf when the hand lever actuator is folded out and allows a sufficiently large distance from the trough, while the height on the inner side remains unchanged or is even smaller.

The above-stated object is met according to the invention in that the hand lever actuator comprises a handle such as a T-handle or L-handle having two connection levers which are arranged relative to one another in a parallelogram configuration and which are articulated by one end at the drive shaft and by the other end in a similar manner at the graspable part or handle in such a way that, on the one hand, they hold the handle in its direction parallel to the extension of the trough when the handle is folded out of the trough and, on the other hand, can transmit a rotational movement of the handle to the drive shaft in the folded out position.

The above-stated object is met in that the T-handle or L-handle, or the like handle, which is easier to manipulate than a diagonally extending folding handle is used with a graspable area which is parallel to the extension of the trough in the folded out position and which, further, because of its shape, is easier to hold than a folding handle of the conventional type but is nevertheless retractable and projects only slightly above the surface of the door in this retracted position.

According to a further development of the invention, a spring which forces the handle into the folded out position is provided between the two connection levers. This makes the handle easier to fold out.

According to another embodiment form of the invention, the trough in the area of the bearing support of the drive shaft forms guide surfaces which only allow the T-handle to be folded in when the handle is oriented with its graspable area parallel to the extension of the trough.

According to another embodiment form of the invention, the trough comprises in the area of the bearing of the handle in the folded in position at least one movable hook which holds the handle in its folded in position.

According to another embodiment form of the invention in which the handle is preferably T-shaped, two hooks which are displaceably supported together in the trough engage behind the two ends of the T-handle either directly or by means of a part articulated thereto.

The hook or hooks is/are advisably held by a slide which is moved out of the position in which they engage behind the handle, such as the T-handle, against spring force by the cam of a cylinder lock or the like and accordingly allows the handle, such as the T-handle, to be folded out.

A cylinder lock or the like can be arranged at the end of the trough remote of the bearing.

The trough can be a cover for the cylinder lock or the like which can be displaced or folded out. This cover can have an opening which is penetrated in the folded in position by an eye protruding from the end of the trough in such a way that folding out and, therefore, access to the cylinder lock is prevented by means of a padlock inserted through the eye.

It is conceivable that snap-type fastening elements project from the trough and secure the trough in an opening through a thin wall such as a sheet metal door leaf.

The snap-type holding elements advisably engage behind the thin wall. On the other hand, the arrangement can be carried out in such a way that the snap-type fastening elements engage behind a cap whose edge rests upon the rear surface of the thin wall and clamps the latter between itself and the trough.

The cap can be part of a latch such as a rod latch.

The cap forming the (rod) latch can be screwed to the trough. Further, an adapter part can be arranged between the trough and the cap forming the (rod) latch in such a way that the thin wall extends between the trough and the adapter part or, alternatively, between the adapter part and the cap (forming the rod latch).

The cylinder lock or the like may be part of an exchangeable unit which can be inserted into the trough from the front.

The exchangeable unit can have a threaded bore hole for a fastening screw which is guided through the (rod) latch and/or cap from the back.

The trough can have at least one threaded bore hole for a fastening screw which is guided through the (rod) latch and/or cap from the back.

BRIEF DESCRIPTION OF THE DRAWINGS

FIGS. 4A, 4B show the hand lever actuator in a sectional view, wherein FIG. 4A shows the folded in hand lever and FIG. 4B shows the folded out hand lever;

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
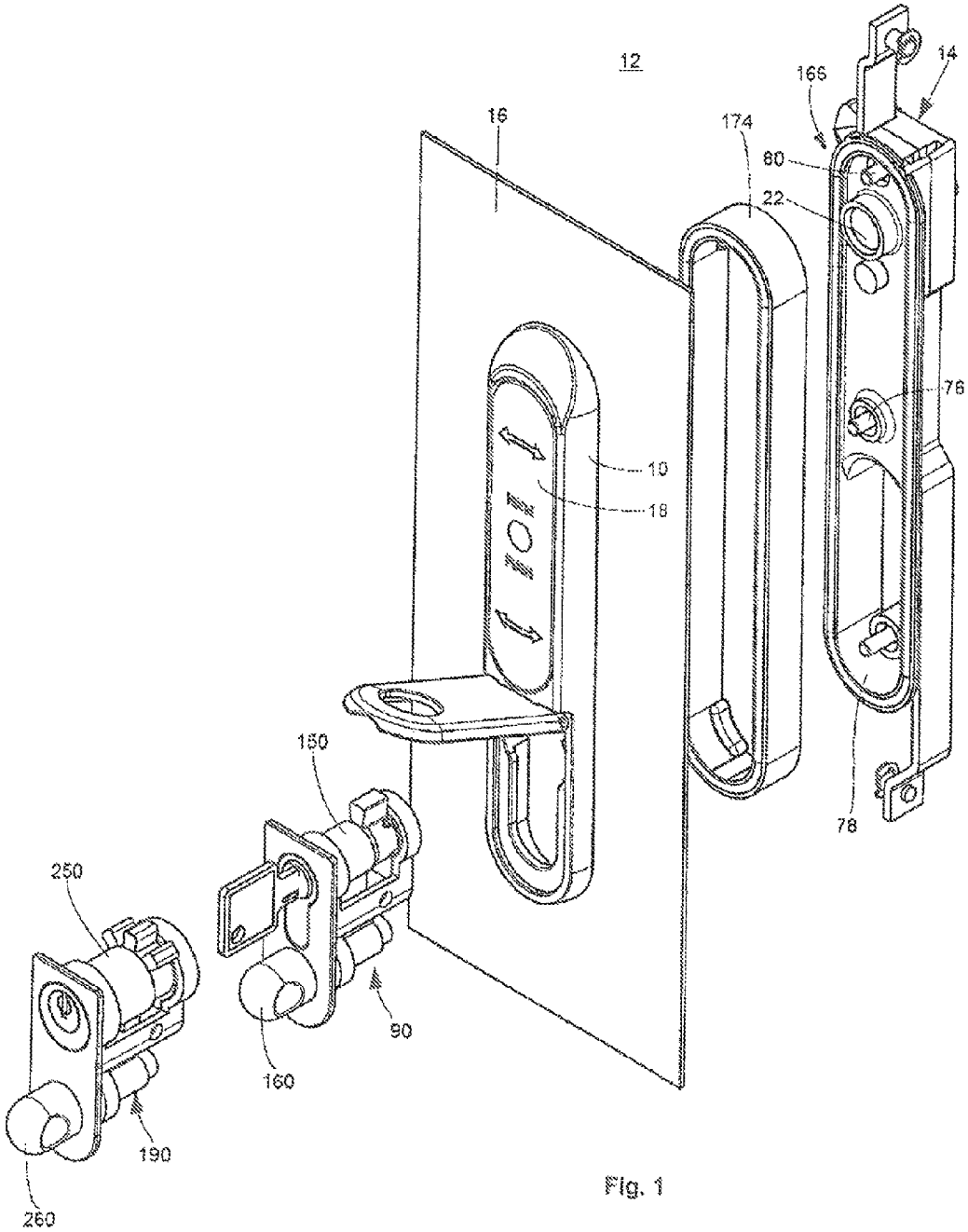
FIG. 1 shows a perspective, exploded view of a retractable hand lever actuator which can be locked in a trough for driving a latch, e.g., a ribbon rod latch in the present case.
Figure 2:
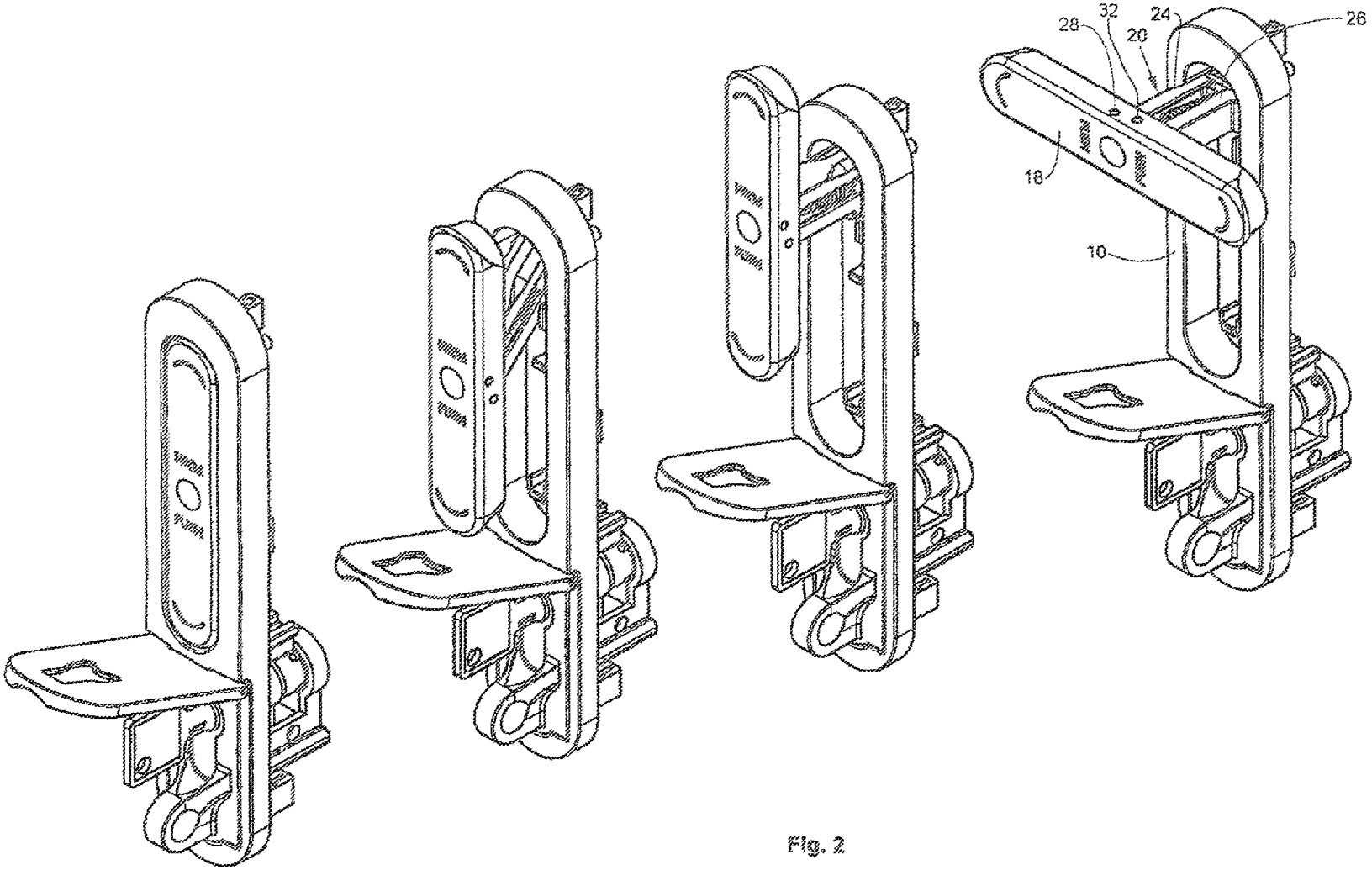
FIG. 2 shows four successive perspective views of the actuating part and the process of folding out and turning the hand lever which is T-shaped in the present case.

FIG. 1 shows a perspective, exploded view of a retractable hand lever actuator 12 which can be locked in a trough 10 for driving a latch, in this case a rod latch 14 for a switch cabinet, of which only the door leaf part 16 is shown in the figure. The hand lever 18 is articulated at a drive shaft 20 mounted in the trough 10 (see also FIG. 2 which shows the trough as an individual part with articulated hand lever). The hand lever actuator 12 comprises a T-handle 18 (see FIG. 5) which has two connection levers 24, 26 arranged relative to one another in a parallelogram configuration. The connection levers 24, 26 are articulated by one end at the drive shaft 20 (see FIG. 4B and FIG. 5) and by the other end in a similar manner at the handle 18 (see articulation points 28, 30 and 23, 32) in such a way that, on the one hand, they hold the handle 18 in its direction parallel to the extension of the trough when the handle is folded out of the trough 10 (see the first three drawings in FIG. 2) and, on the other hand, can transmit a rotational movement of the handle to the drive shaft (see the fourth drawing in FIG. 2) in the folded out position as is shown in the third drawing in FIG. 2.

Figure 4A:
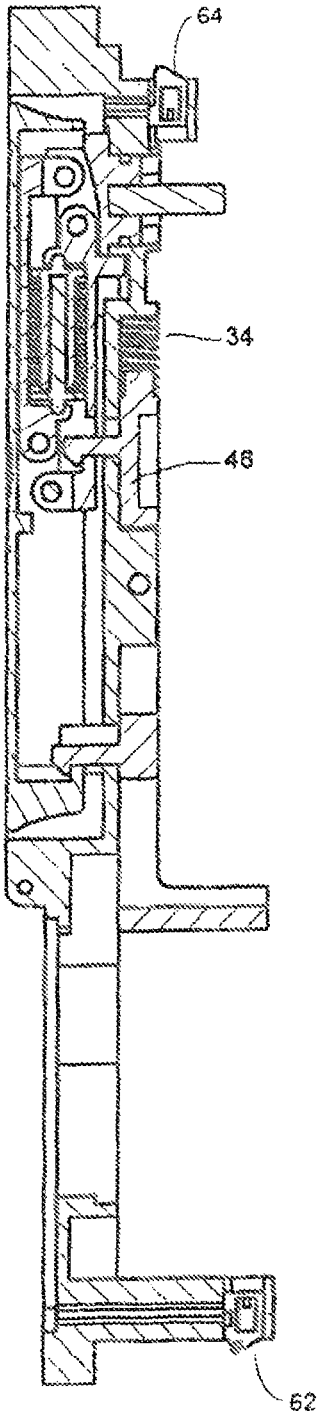
Figure 4B:
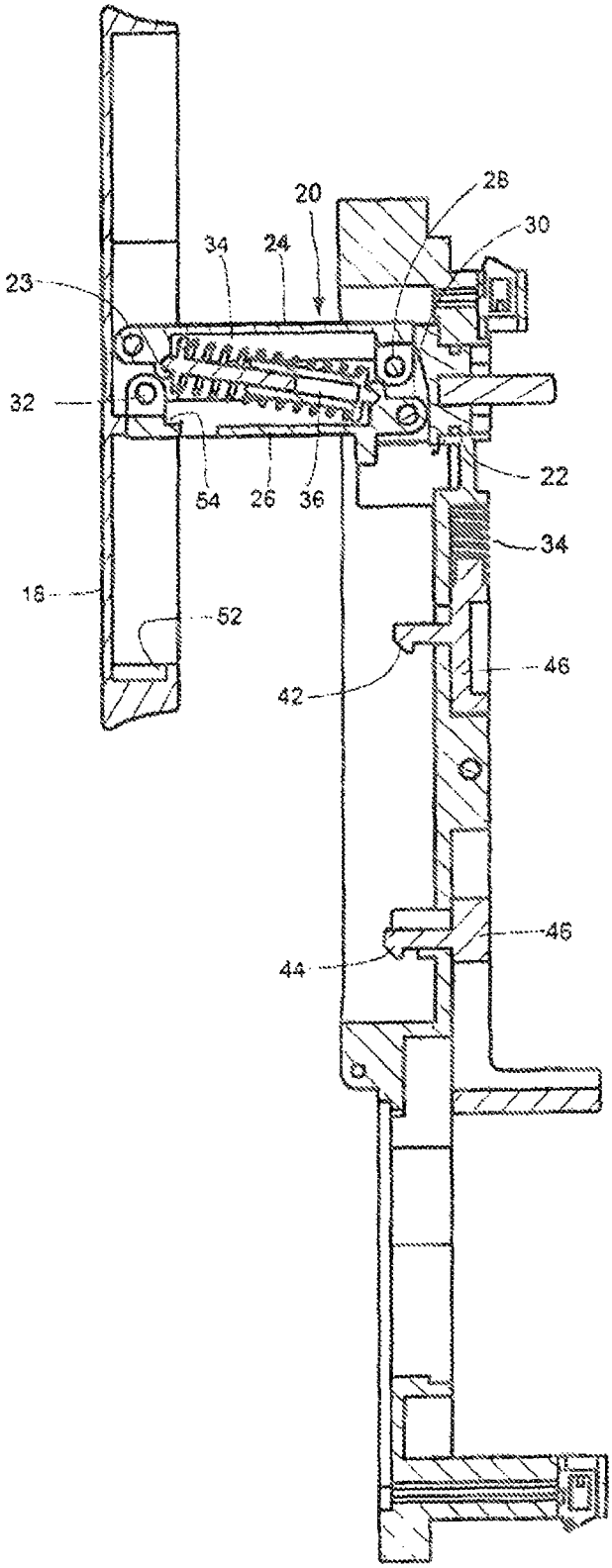
Figure 5:
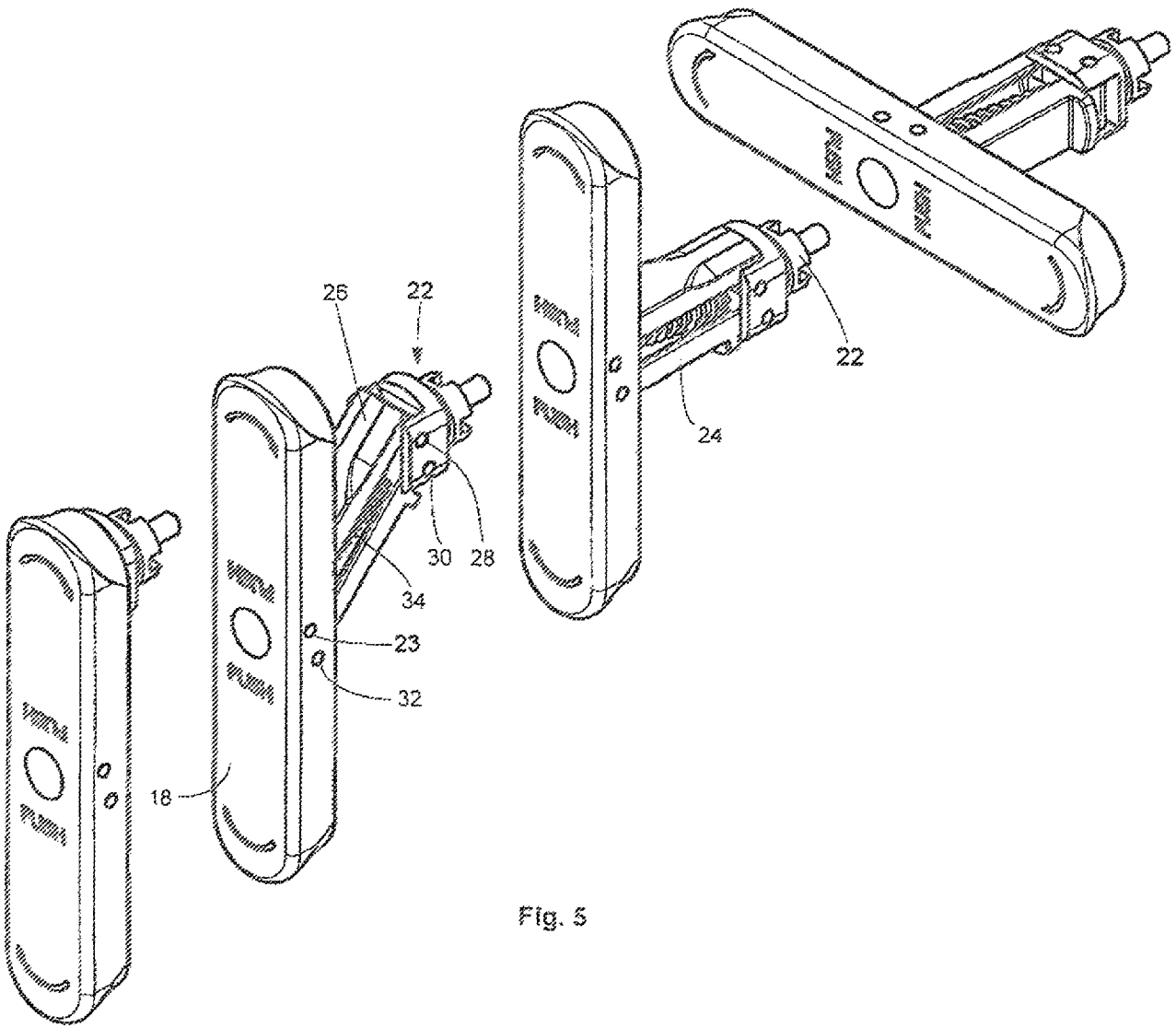
FIG. 5 shows four successive perspective views of the hand lever as an individual part in different positions.

The graspable part of the hand lever 18 is trough-shaped (see particularly FIG. 4B), and the articulations 23, 32 are carried out at the edges of the trough. The trough allows both of the levers 24, 26 to be accommodated in the folded in position as is shown in FIG. 4A. On the other hand, the trough 10 receives the hand lever 18, including levers 24, 26, in the folded in position so that this construction has only a small height in the folded in position (see FIG. 1). FIG. 4B also shows that a spring 34 is provided between the two connection levers 24, 26. The spring 34 forces the T-handle 18 into the folded out position in that the levers 24, 26 are forced outward out of their folded in position.

The spring 34 is arranged between the two levers 24, 26 in such a way that it is compressed when the latter are folded in as can be seen in FIG. 4A. The spring is guided by a piston-cylinder arrangement 36 whose ends are held in the lever end with articulation point 30 in one instance and in the lever end with articulation 23 in the other instance such that a torque results which forces the levers into the folded out position.

Figure 3:
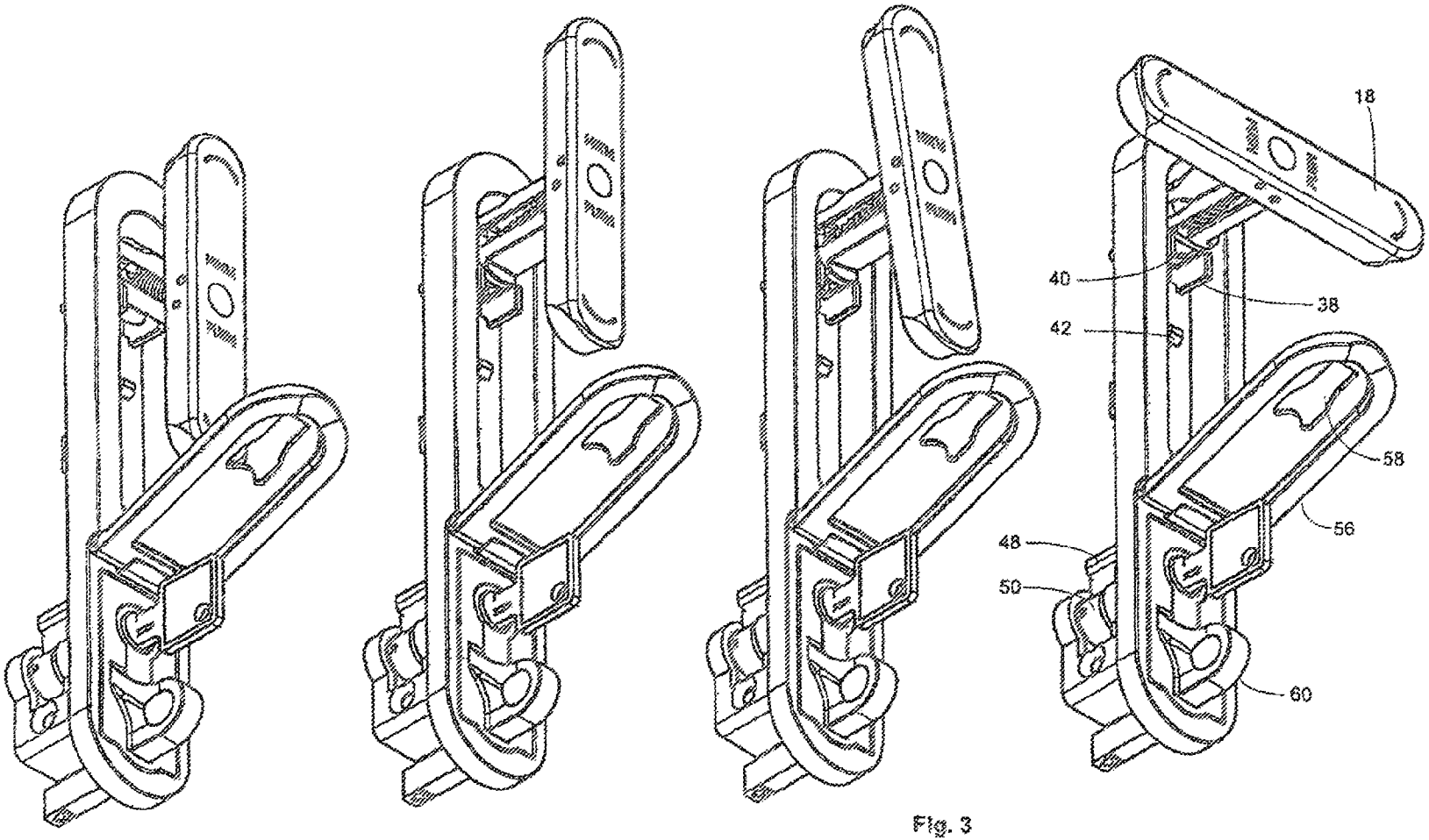
FIG. 3 shows a similar view showing the hand lever actuator from a somewhat different direction in various positions of the hand lever.

The trough forms guide surfaces 38, 40 in the area of the bearing support 22 of the drive shaft 20 which only allow the T-handle 18 to be folded in when the T-handle is oriented with its graspable part parallel to the extension of the trough as is shown in the second drawing in FIG. 3, whereas folding in is not enabled in the rotated position as can be seen, for example, from the position of the T-handle shown in the last drawing in FIG. 3.

The trough 10 has at least one movable hook 42, 44 (see FIG. 4B) in the folded in position in the area of the bearing of the T-handle 18 in order to hold the T-handle in its folded in position. The two hooks are supported by a shared slide 46 which is moved against spring force 34 by means of the cam 48 of a cylinder lock 50, or the like, out of the position in which the T-handle is held in the trough and accordingly releases the T-handle 18 and allows it to be folded out.

In the embodiment form shown in FIG. 4B, a catch for the hook 44 is formed by an offset 52 in the T-handle 18, while the other catch 54 for hook 42 is formed by the lever 26 in the folded in position.

While one end of the elongated trough 10 forms the bearing 22 for the drive shaft 20, the cylinder lock 50 is arranged at the opposite end of the trough 10. Further, the trough 10 can have a cover 56 for the cylinder lock 50, which cover 56 can be displaced or folded out. This protects the cylinder from dust on the one hand and, on the other hand, provides an additional safeguard against unauthorized opening in that the cover 56 has an opening 58 which is penetrated in the folded in position of the cover 56 by an eye 60 projecting from one end of the trough such that folding out and, therefore, access to the cylinder lock 50 is prevented by means of a padlock inserted through the eye 60. Alternatively, the eye-shaped projection 160, 260 (see FIG. 1) can also be part of an exchangeable unit which can be inserted into the trough 10 from the front and then secured by means of a screw 78 or the like.

Figure 6A:
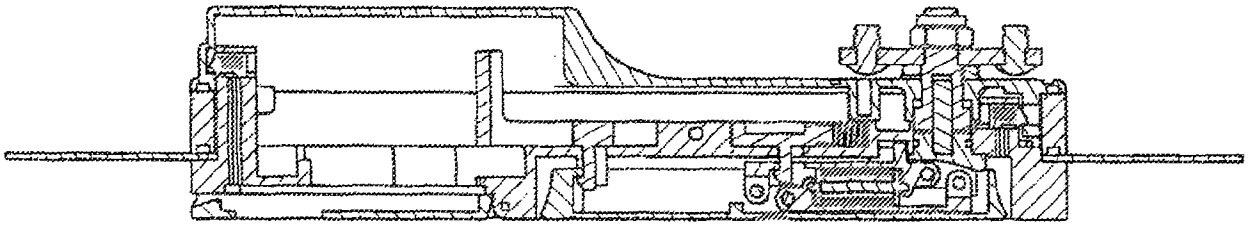
FIG. 6A shows a longitudinal section through a hand lever actuator assembled with an adapter part and secured in or to the door leaf.
Figure 6B:
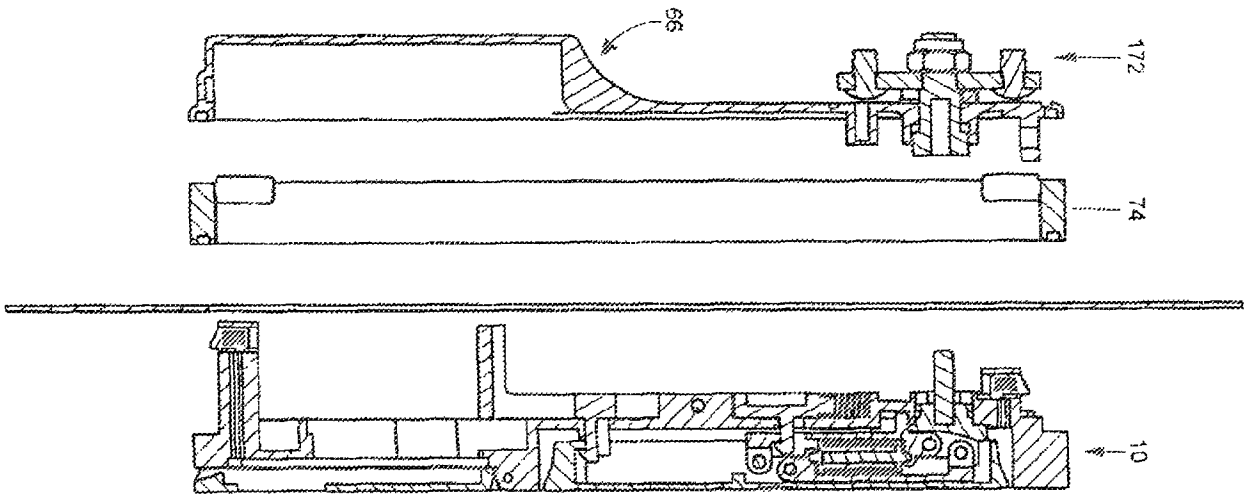
FIG. 6B shows the hand lever actuator according to FIG. 6A, but prior to mounting.

Snap-type fastening elements 62, 64 can from the trough 10 and hold the trough 10 in an opening through a thin wall such as a sheet metal door leaf 16. For this purpose, the snap-type fastening elements 62, 64 can either engage behind the thin wall 16 directly or the snap-type fastening elements 62, 64 penetrate or engage behind a cap 66 whose edge 68 rests upon the rear surface 70 of the door leaf 16 and clamps this thin wall 16 between itself and the trough 10 (see FIG. 7B). The cap 66 can be part of a latch, e.g., a rod lock case 72 or a lever drive 172 (see FIGS. 7A, 7B; FIGS. 6A, 6B) or can carry this latch. Instead of connecting the cap and trough to one another by snap-in devices, screws can also be used as is shown in FIG. 1. In either case, it is possible to provide an adapter part 74, 174 which can be arranged between the trough 10 and the cap 66 forming the (rod) latch in such a way that the door leaf 16 extends between the trough 10 and the adapter part 74 or, alternatively, between the adapter part 74 and the cap 66 forming the rod latch. This alternative is shown in FIGS. 6A and 6B. The other alternative is shown in FIGS. 7A, 7B.

Figure 7B:
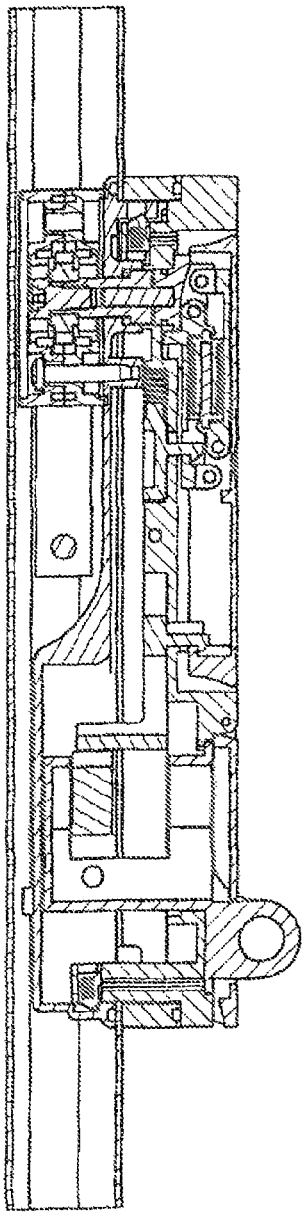
FIG. 7B shows the arrangement according to FIG. 7A in the assembled state mounted at a door leaf.
Figure 7A:
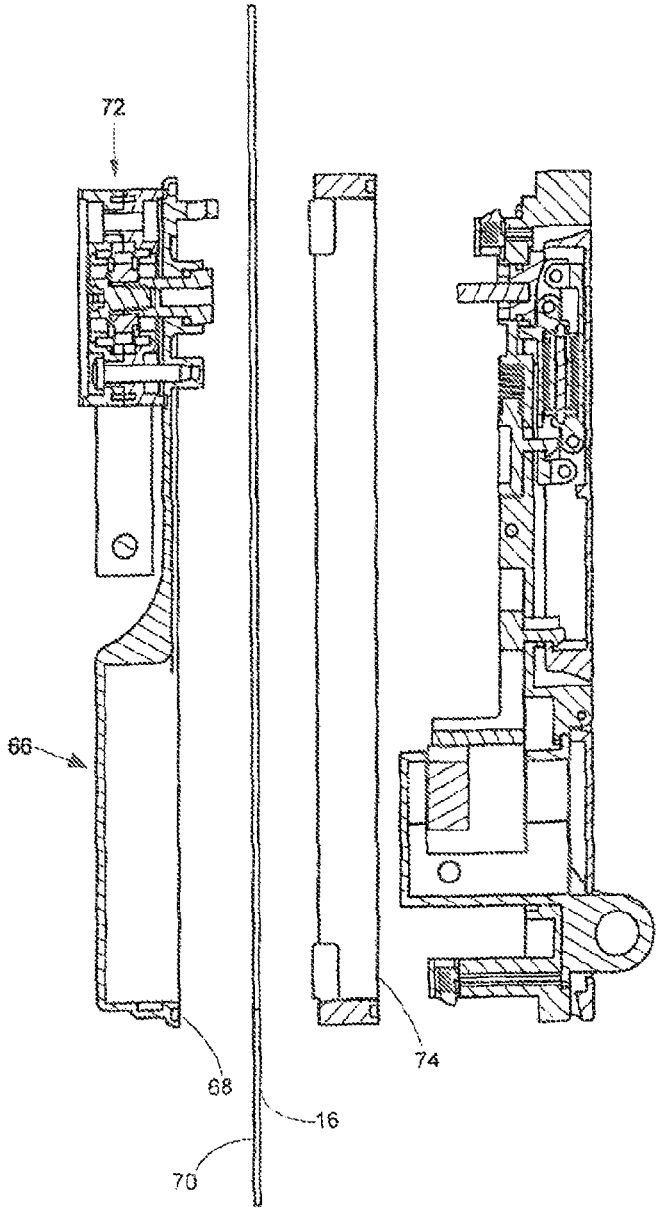
FIG. 7A shows a similar embodiment form, but with a lock case rod drive.

The cylinder lock 50, 150, 250, or the like, may be part of an exchangeable unit 90, 190 which can be inserted into the trough 10 from the front (see FIG. 1 and FIGS. 7A, 7B). This exchangeable unit can have a threaded bore hole for a fastening screw 78 which is guided through the (rod) latch and/or cap 166 from the rear. The trough has additional screw fastening points, shown in FIG. 1, for screws 76, 80.

Industrial Applicability

The invention is industrially applicable in switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

Reference Numbers:
10 trough
12 hand lever actuator
14 (rod) latch
16 door leaf of a switch cabinet
18 hand lever, T-handle
20 drive shaft
22 bearing support
23 articulation (point)
24 connection lever
26 connection lever
28 articulation (point)
30 articulation (point)
32 articulation (point)
34 spring
36 piston-cylinder arrangement
38 guide surface
40 guide surface
42 hook
44 hook
46 slide
48 cam
50, 150, 250 cylinder lock
52 catch
54 catch
56 cover
58 opening
60, 160, 260 projection
62 snap-type fastening element
64 snap-type fastening element
66, 166 cap
68 edge
70 rear surface
72, 172 rod lock case, lever drive
74, 174 adapter part
76 fastening screw
78 fastening screw
80 fastening screw
90, 190 unit

The invention claimed is:

1. A retractable hand lever actuator which can be locked in a trough for driving a latch for a cabinet, the hand lever actuator comprising:

a handle, the handle being articulated at a drive shaft which is supported in the trough;

wherein the handle has two connection levers which are arranged relative to one another in a parallel configuration; and wherein the two connection levers are articulated by one end at the drive shaft and by the other end in a similar manner at the handle in such a way that the two connection levers (1) hold the handle in its direction parallel to the extension of the trough when the handle is folded-out of the trough, and (2) are able to transmit a rotational movement of the handle to the drive shaft in the folded-out position.

2. The retractable hand lever actuator according to claim 1;

wherein a spring, which forces the handle into the folded-out position, is provided between the two connection levers.

3. The retractable hand lever actuator according to claim 1;

wherein the trough, in the area of a bearing support of the drive shaft, forms guide surfaces which only allow the handle to be folded-in when the handle is oriented with its graspable area parallel to the extension of the trough.

4. The retractable hand lever actuator according to claim 3;

wherein the trough comprises, in the area of the bearing support of the handle in the folded-in position, at least one movable hook which holds the handle in its folded-in position.

5. The retractable hand lever actuator according to claim 4;

wherein two hooks, which are displaceably supported together in the trough, engage behind the handle either directly or by means of a part articulated to the handle.

6. The retractable hand lever actuator according to claim 5;

wherein one of the hooks is held by a slide which can be moved out of the position in which the one hook engages behind the handle, against a spring force, by a cam of a first lock, thereby allowing the handle to be folded out.

7. The retractable band lever actuator according to claim 6;

wherein the first lock is arranged at an end of the trough remote from the bearing support.

8. The retractable hand lever actuator according to claim 7;

wherein the trough has a cover for the first lock; and wherein the cover can be displaced or folded out.

9. The retractable hand lever actuator according to claim 8;

wherein the cover has an opening which is penetrated in the folded-in position of the cover by an eye projecting from the end of the trough; and wherein a padlock is inserted through the eye in such a way that the cover is prevented from being folded out, thereby preventing access to the first lock.

10. The retractable hand lever actuator according to claim 1;

wherein snap-type fastening elements project from the trough and secure the trough in an opening through a door leaf.

11. The retractable hand lever actuator according to claim 10;

wherein the snap-type fastening elements engage behind the door leaf.

12. The retractable hand lever actuator according to claim 10;

wherein the snap-type fastening elements engage behind a cap whose edge rests upon a rear surface of the door leaf, the door leaf being clamped between the edge of the cap and the trough.

13. The retractable hand lever actuator according to claim 12;

wherein the cap is part of the latch.

14. The retractable hand lever actuator according to claim 13;

wherein the cap is screwed to the trough.

15. The retractable hand lever actuator according to claim 14;

wherein an adapter part is provided which extends between the trough and the cap.

16. The retractable hand lever actuator according to claim 6;

wherein the first lock is part of an exchangeable unit which can be inserted into the trough from the front.

17. The retractable hand lever actuator according to claim 16;

wherein the exchangeable unit has a threaded bore hole for a fastening screw which is guided through the latch from the back.

18. The retractable hand lever actuator according to claim 17;

wherein the trough has at least one threaded bore hole for at least one additional fastening screw which is guided through the latch and/or the cap from the back.

19. The retractable hand lever actuator according to claim 15;

wherein the adapter part provides space for parts of the hand lever actuator; and wherein this space is arranged either in front of or behind the door leaf, so that this space is moved behind the door or in front of the door, respectively.

20. The retractable hand lever actuator according to claim 16;

wherein snap-type fastening elements project from the trough and secure the trough in an opening through a door leaf;

wherein the snap-type fastening elements engage behind a cap whose edge rests upon a rear surface of the door leaf, the door leaf being clamped between the edge of the cap and the trough; and wherein the exchangeable unit has a threaded bore hole for a fastening screw which is guided through the latch and/or the cap from the back.

* * * * *